US005349512A

United States Patent [19]

Parker

[11] Patent Number: 5,349,512

[45] Date of Patent: Sep. 20, 1994

[54] ELECTRICAL LANTERN WITH MULTIPLE POSITION CONNECTING HANDLE

[76] Inventor: David H. Parker, 2255 Jefferson St., Torrance, Calif. 90501

[21] Appl. No.: 164,567

[22] Filed: Dec. 10, 1993

[51] Int. Cl.[5] ..... F21L 15/12

[52] U.S. Cl. ..... 362/399; 362/191

[58] Field of Search ..... 362/191, 190, 399

[56] References Cited

U.S. PATENT DOCUMENTS 4,734,832 3/1988 Moriano et al. ..... 362/399 X 5,142,678 8/1992 Yuen ..... 362/399

*Primary Examiner*—Stephen F. Husar

*Attorney, Agent, or Firm*—Matthew P. Lynch

[57] ABSTRACT

A lantern which is battery powered and is contained within a casing. Mounted on the exterior wall of the casing are a plurality of spaced apart rail-type attachments. A separate handle is to be securely mounted onto either of the rail-type attachments. The handle can be mounted in various positions in conjunction with the rail. Also, the longitudinal positioning of the handle on the rail can be varied according to individual desires. Once the desired position is obtained, the handle is fixedly secured to the rail.

6 Claims, 1 Drawing Sheet

ELECTRICAL LANTERN WITH MULTIPLE POSITION CONNECTING HANDLE

BACKGROUND OF THE INVENTION

The field of this invention relates to portable electrical lighting devices commonly referred to as a hand lantern and more particularly to a multiple position connectable handle that is to be used in conjunction with the casing of the lantern.

Portable electrical lighting devices, such as what is commonly referred to as a flashlight, are in widespread usage. Such devices are commonly used by sportsmen, motorists, homeowners and office workers. The common construction of such devices is in the form of a casing which generally assumes a somewhat cylindrical configuration. The forward or front end of the casing terminates in a lens assembly. There is a hand operated switch mounted on the casing which when moved to an activated positon will cause a beam of light to be projected through the lens assembly to be projected onto a given area that is selected by the individual holding the lantern.

Some lanterns have a separate handle attached thereto with a common form of type of handle resembling a "pistol grip". Most often the pistol grip is fixedly secured to the casing of the lantern. However, in the past it has been known to construct the pistol grip handle to be movable to different positions such as by being pivotally mounted on the casing. The intention is to provide versatility so that in a tight quartered or unusual environment the casing of the lantern can be oriented at a desired angle relative to the handle so that the beam of light of the lantern can be pointed in a particular direction.

Also, certain individuals, because of physical problems such as arthritis or the like, are not able to utilize a conventional pistol grip type of handle. However, if the handle was located in another position, so that the handle could be grasped in a different position, then possibly that individual could utilize such a handle. However, within the prior art, it has not been known to give any consideration to repositioning of a handle on a lantern so that it can be more comfortable for a particular user.

SUMMARY OF THE INVENTION

The electrical lantern of the present invention includes a casing within which is to be located a battery and to which is attached a lens assembly through which a beam of light is to be projected. Mounted on the casing are a pair of spaced apart rails with these rails functioning as an attachment for a handle. The handle may be attached to either rail and when attached to one rail, the on/off switch is located in a lower position, and when attached to the other rail, the on/off switch is located in an upper position. The handle includes a pair of connecting means with these connecting means being located approximately ninety degrees apart. Each rail could be connected to either connecting means. When a rail is connected with one of the connecting means, the grasping handle is located substantially transverse to the longitudinal center axis of the casing of the lantern. When connected to the other connecting means, the longitudinal axis of the handle is located substantially parallel to the longitudinal center axis of the casing. With either connecting means, the handle may be oriented in a forward position or in a reverse position with the reverse position being one hundred eighty degrees displaced from the forward position.

The primary objective of the present invention is to provide an electrical lantern with a handle to be connected to the casing of the electrical lantern and this handle to be removable so as to accommodate individual user desires regarding positioning of the handle.

Another objective of the present invention is to construct a removable handle for a lantern casing which is constructed simple, easy to operate, and can be manufactured at a reasonable price and therefore sold to the ultimate consumer at a reasonable price.

Another objective of the present invention is to provide a removable handle for a lantern which can permit the handle to be used with or without the handle and when used with the handle, the handle can be oriented in a wide variety of different positions so as to not only accommodate individual comfort of the particular user but also permits variation in overall width of the lantern to accommodate to tight quartered or unusual quartered situations,

DETAILED DESCRIPTION OF THE SHOWN EMBODIMENT

Figure 1:
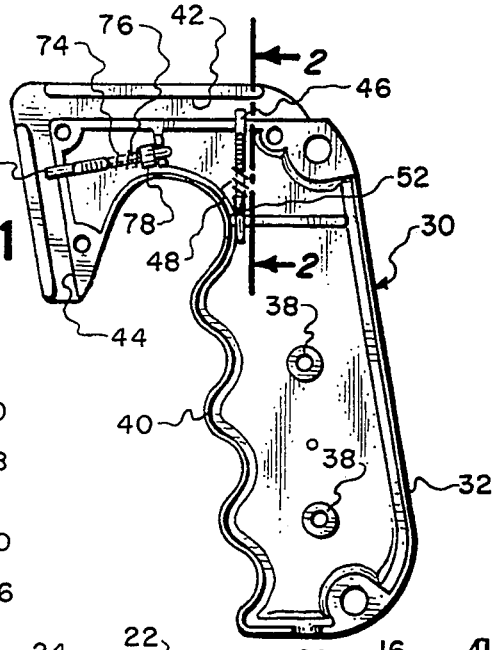
FIG. 1 is a side elevational view through one of the parts of the two parts of the handle assembly utilized in conjunction with the lantern of the present invention.
Figure 2:
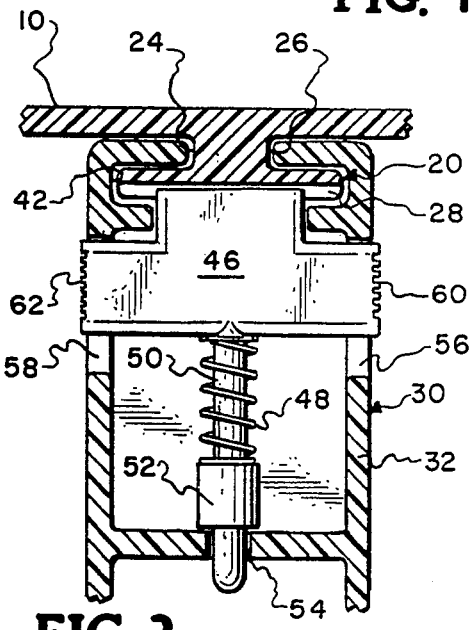
FIG. 2 is a cross-sectional view showing the locking mechanism associated with the handle of the present invention taken along line 2—2 of FIG. 1.

Referring particularly to the drawing, there is shown a lantern having a casing 10 which terminates at its forward end into a lens assembly 12. Lens assembly 12 includes a screw tightening collar 14. Supported interiorly of the collar 14 is a lens (not shown) through which the beam of light is to be conducted. The energy for the beam of light is to be supplied by a battery (not shown) which is to be contained within the casing 10. A secure watertight connection is to be established between the collar 14 and the annular flange 16 of the casing 10.

Mounted on the casing 10 is an on/off switch 18. The on/off switch 18 is to be located directly adjacent the back edge of the flange 16. The on/off switch is to control the supply of power from the battery to the lamp contained within casing 10. Also, integrally formed on the exterior surface of the casing 10 just aft of the on/off switch 18 is a longitudinal rail 20. An essentially identical rail 22 is also integrally mounted on the casing 10 with the rail 22 being mounted approximately one hundred eighty degrees apart from the rail 20 on the casing 10. However, it is considered to be within the scope of this invention that the location of the rails 20 and 22 is deemed to be a matter of choice. In actual practice, there may also not be used a pair of rails but only a single such rail. Still further, there may be utilized three or four different rails. Still further, although the rails 20 and 22 are located substantially parallel as far as their longitudinal axes go, it is considered to be within the scope of this invention that the rails could be mounted in a non-parallel relationship.

Each of the rails 20 and 22 include a pair of opposing longitudinal side grooves 24 and 26. Mounted within the outer surfaces of the rails 20 and 22 are a plurality of equally spaced apart recesses or detents 28. It is to be noted that there are eight in number of detents 28 mounted on each rail 20 and 22. However, it is to be understood that this number of detents 28 could be increased or decreased without departing from the scope of this invention. Also, the spacing between the detents 28 could be readily varied.

Handle 30 is composed of a pair of parts 32 and 34 which are connected together in a facing relationship. Parts 32 and 34 are to be secured together by means of a conventional screw fasteners 36 which are to threadably connect with upstanding bosses 38 integrally mounted on the interior surface of the part 32.

Parts 32 and 34 cooperate together to form a handgrip 40. The parts 32 and 34 form a first dovetail slot 42 which is oriented substantially transverse to the longitudinal center axis of the handle 30. A second dovetail slot 44 is mounted within the handle 30 and is located substantially parallel and spaced from the longitudinal center axis of the handle 30.

Figure 3:
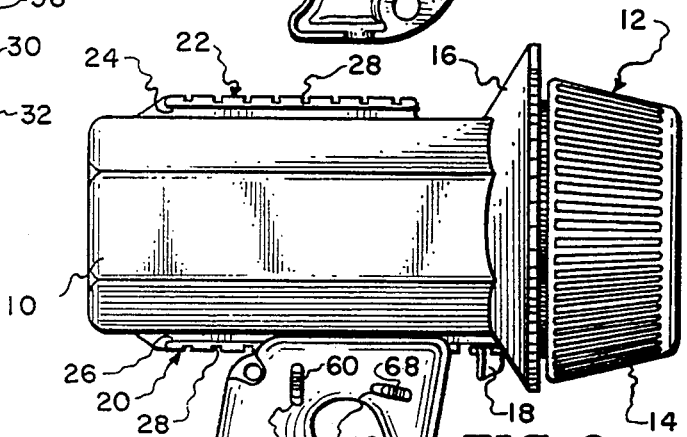
FIG. 3 is a side elevational view of the assembled handle of the present invention showing such attached to a typical lantern with which the handle is used and showing the handle in a typically used forward or pistol grip type of position.
Figure 4:
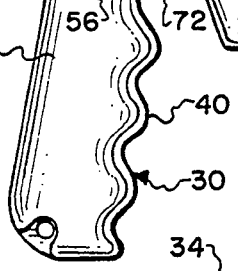
FIG. 4 is a side elevational view similar to FIG. 3 but showing the handle in a reversed longitudinal position relative to the lantern.
Figure 4:
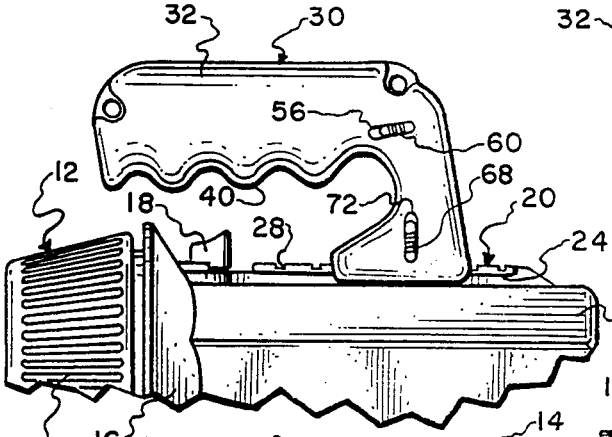
Figure 5:
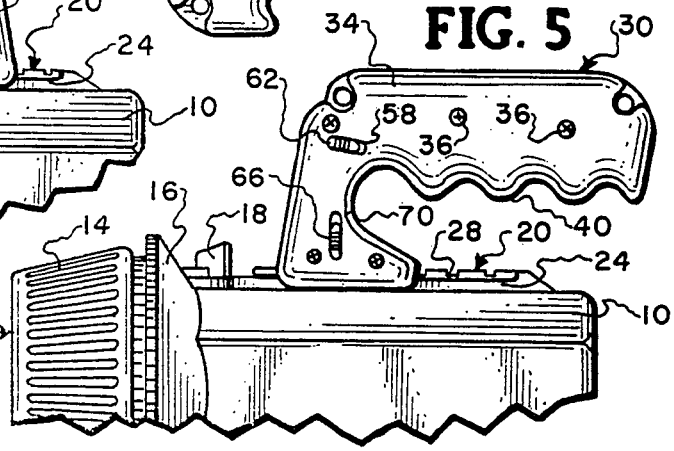
FIG. 5 is a view similar to FIG. 4 but showing the handle in a forward located longitudinal position.

Either the slot 42 or the slot 44 is to be slidingly connectable to either rail 20 or 22. When the slot 44 is connected to a rail 20 or 22, the longitudinal axis of the handle 30 is located substantially parallel to the longitudinal center axis of the casing 10 as is clearly shown in FIGS. 4 and 5 of the drawing. Also, in comparing FIGS. 4 and 5, it is to be noted that handle 30 can be mounted in a forward longitudinal direction as shown in FIG. 5 or in a reverse longitudinal direction as shown in FIG. 4. In FIG. 3, only the foward position of the pistol-type grip is shown with the rail 20 connecting with the slot 42. However, the handle 30 could be turned around one hundred eighty degrees when connecting with the rail 20 and be in the reversed position.

If the user finds it difficult to operate the on/off switch 18 for the lantern when the handle 30 is in the position shown in FIG. 3, the user may optionally mount handle 30 in conjunction with the rail 22 which would place the on/off switch 18 spaced from the handle 30. If it is considered that the handle 30 is mounted along the bottom edge of the lantern, then the on/off switch 18 would be located along the top edge of the lantern.

In order to securely lock the handle 30 when mounted on either rail 20 or 22, there is to be utilized a locking pawl 46 which is to be engageable with any detent 28. The pawl 46 is continuously spring biased by a spring 48 to normally extend within the confines of the dovetail slot 42. Spring 48 is supported on a pin 50 which has an enlarged outer end 52, a portion of which is mounted within a hole 54. The outer end of the pin 50 rests with in a hole formed in the pawl 46. The side flanges of the pawl 46 rests within slots 56 and 58 formed respectively within parts 32 and 34. The outer surface of the side flange of the pawl 46 resting within the slot 56 is formed into a serrated surface 60. In a similar manner the side flange of the pawl 46 that rests within the slot 58 is formed into a serrated surface 62.

Manual squeezing action applied simultaneously to the serrated surfaces 60 and 62 exerting a force against the spring 48 tending to cause the pawl 46 to be moved out of engagement with the slot 42 will permit the handle 30 to move to any desired longitudinal position along either rail 20 or 22. Once the established position is achieved, the operator releases pawl 46 resulting in the pawl 46 moving into engagement with one of the detents 28 thereby securely locking in position the handle 30 onto the casing 10.

It is to be understood that associated with the second dovetail slot 44 is a pawl 64 which is essentially identical to pawl 46 and operates in the same way. Pawl 64 has side flanges which have serrated surfaces 66 and 68. The side flange which has serrated surface 66 rides within a slot 70 formed in part 34. The side flange which has serrated surface 68 rides within slot 72 formed within part 32. The pawl 64 is spring biased by a spring 74 which is mounted on a pin 76 which is attached to enlarged head 78. It is to be understood that the pawl 64 is to be used in precisely the same manner as pawl 46 with pawl 64 only being used when the rails 20 or 22 are connecting with the slot 44.

What is claimed:

1. An electrical lantern comprising:

a casing having a lens assembly through which a beam of light is to be emitted, said casing having an exterior wall surface;

an attachment mounted on said exterior wall surface; and a graspable handle connected with said attachment, said graspable handle including connecting means, said attachment including a locking detent, said connecting means including a locking pawl, said locking pawl being continuously spring biased toward a locking position capable of connecting with said locking detent, with said locking pawl in said locking position and connecting with said locking detent said graspable handle being fixedly secured to said casing.

2. The electrical lantern as defined in claim 1 wherein:

there being a pair of said attachments located in a spaced apart manner on said exterior wall surface of said casing.

3. The electrical lantern as defined in claim 2 wherein:

each said attachment being essentially identical.

4. The electrical lantern as defined in claim 3 wherein:

each said attachment being in the form of a rail, each said rail including a plurality of spaced apart recesses with each said recess forming a said locking detent.

5. The electrical lantern as defined in claim 1 wherein:

said attachment comprising an elongated rail, said connecting means comprising a slot, said elongated rail connecting with said slot permitting sliding movement of said graspable handle relative to said casing, said attachment including a plurality of said locking detents, said locking pawl being capable of engaging with any one of said locking detents, said locking pawl being manually movable from said locking position to an unlocking position which permits sliding movement of said graspable handle relative to said casing.

6. The electrical lantern as defined in claim 1 wherein:

said graspable handle including a plurality of connecting means located in a spaced apart manner on said graspable handle, each said connecting means being connectable with a said attachment means, only a single said connecting means being connectable with a said attachment means at a given time, said handle being in a different position when one said connecting means is connected with said attachment means than when the other said connecting means is connected with said attachment means.

* * * * *